US005569042A

United States Patent [19]

Mosebach

[11] Patent Number: 5,569,042

[45] Date of Patent: Oct. 29, 1996

[54] LIGHT FIXTURE WITH SAFETY SOCKETS

[75] Inventor: Garry M. Mosebach, Chicago, Ill.

[73] Assignee: Appleton Electric Company, Chicago, Ill.

[21] Appl. No.: 394,780

[22] Filed: Feb. 27, 1995

[51] Int. Cl.[6] ..... H01R 33/02

[52] U.S. Cl. ..... 439/237

[58] Field of Search ..... 439/237, 239, 439/242, 243, 244

[56] References Cited

U.S. PATENT DOCUMENTS

| | | | |
|---|---|---|---|
| 2,626,976 | 1/1953 | Howenstine | 173/328 |
| 2,668,277 | 2/1954 | Anderson et al. | 339/52 |
| 2,715,216 | 8/1955 | Howenstine | 339/275 |
| 2,728,057 | 12/1955 | O'Donnell et al. | 339/57 |
| 2,743,424 | 4/1956 | Hassinger | 339/52 |
| 2,847,561 | 8/1958 | Huerkamp et al. | 240/51.11 |
| 2,883,639 | 4/1959 | Kulka | 339/52 |
| 2,995,722 | 8/1961 | Pistey | 339/51 |
| 3,002,172 | 9/1961 | Lennox | 339/52 |
| 3,035,164 | 5/1962 | Thomas et al. | 240/11.4 |
| 3,097,903 | 7/1963 | Moore | 339/55 |
| 3,287,688 | 11/1966 | Laurenzo | 339/56 |
| 3,290,638 | 12/1966 | Pistey | 339/56 |
| 3,426,312 | 2/1969 | Fitz Gerald | 339/56 |
| 3,751,657 | 8/1973 | Sangiamo et al. | 240/41.35 |
| 3,832,540 | 8/1974 | Roth | 439/237 |
| 4,918,582 | 4/1990 | McIngvale, Jr. et al. | 362/217 |
| 5,122,074 | 6/1992 | Maag et al. | 439/237 |

FOREIGN PATENT DOCUMENTS

| | | |
|---|---|---|
| 246277 | 4/1966 | Germany . |
| 631356 | 11/1949 | United Kingdom . |

*Primary Examiner*—Khiem Nguyen
*Assistant Examiner*—Yong Kim
*Attorney, Agent, or Firm*—Jones, Day, Reavis & Pogue

[57] ABSTRACT

A light fixture for a double-ended lamp includes a first insulator containing a first electrical socket and a well in communication therewith and having a greater depth than the first socket. A second insulator has a second electrical socket and a slot in communication with the second socket and is biased by a spring into a first position. To install the lamp, a first end of the lamp is placed into the well and a second end of the lamp is then slid through the slot in the second insulator into contact with the second socket. The second insulator is then retracted into a second position to allow the first end of the lamp to slide from the well into the first socket. The second insulator is released to allow the bias of the spring to press upon the ends of the lamp to firmly secure each end into its respective socket.

17 Claims, 2 Drawing Sheets

FIG. 1
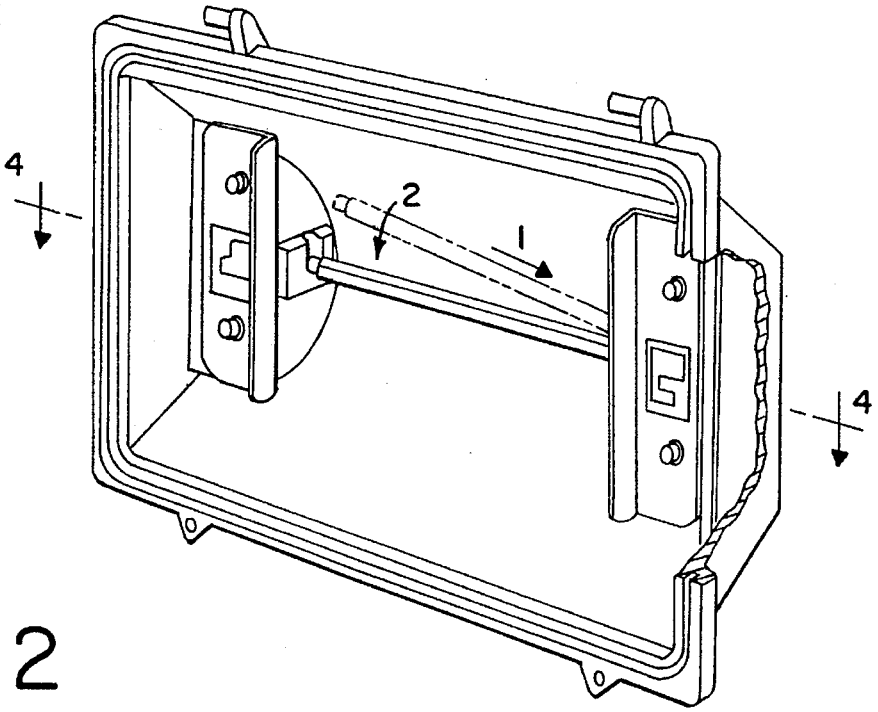
FIG. 2
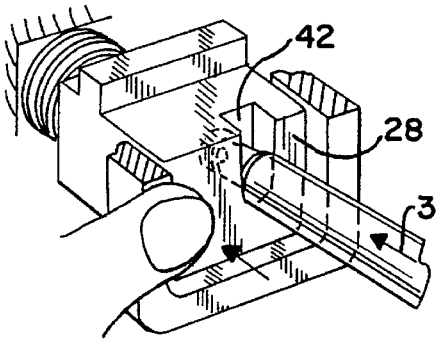
FIG. 3
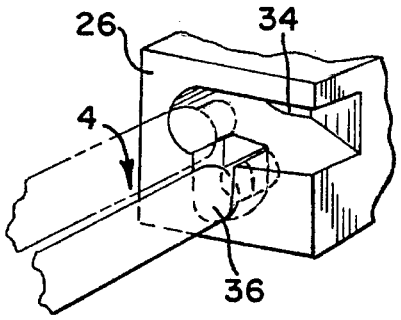
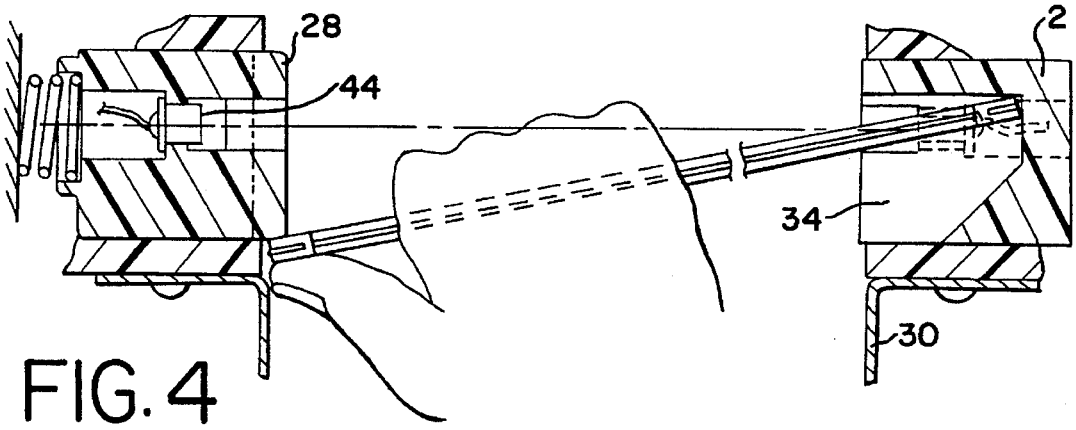
FIG. 4

LIGHT FIXTURE WITH SAFETY SOCKETS

BACKGROUND

1. Field of the Invention

This invention pertains to a fixture for housing an electrical lamp with two electrical terminals. The invention specifically pertains to a mechanism for facilitating safe installation of the lamp into the light fixture.

2. Description of Related Art

The light fixtures of the related art are commonly known as floodlights. The Quartzlite™ Series G500 and G1500 sold by Appleton® Electric Company are commercially available floodlights. Floodlights are used in the outdoors for industrial, sporting or commercial settings where the light must be distributed with efficiency and control.

Floodlights have two basic components: a double-ended lamp for providing light and a light fixture for housing the lamp. The double-ended electrical lamp typically has a cylindrical, glass casing sealed at each end with an insulator surrounding an electrical terminal. A filament runs between the two terminals to deliver electrical current from one terminal to the other terminal. The interior of the casing is subjected to a vacuum or is filled with a non-combustible halogenic gas to prevent damage to the filament. The filament is typically made from tungsten.

The light fixture for the double-ended lamp comprises a housing with two sockets, each socket for receiving a respective end of the lamp. One of the sockets is usually biased by a spring toward the center of the fixture. To install a lamp in the fixture, one end of the lamp is inserted into a respective socket and the spring loaded socket is pushed against the bias of the spring to make room for the lamp to fit in the other socket. Once the lamp is disposed between the two sockets, the spring-loaded socket is released to allow the bias of the spring to bear the spring-loaded socket against the respective end of the lamp. As a result, the sockets firmly engage the terminals of the lamp. The sockets are each connected to an electrical circuit, so that current flows from the electrical circuit through the lamp to illuminate the filament when the fixture is energized.

It is well known in the art that when installing a lamp into the light fixture, all electricity to the fixture should be shut off. Written warnings to this effect are included with the floodlights that are commercially available. In the unforeseeable event that an installer were to ignore these warnings and attempt to install a lamp into such a fixture without shutting off the power, the installer could experience an electrical shock under the following limited circumstances. If the installer does not shut off the power to the light fixture and inserts one of the terminals of the lamp into an electrically live socket and then touches the other end of the lamp, the installer could experience an electrical shock. Moreover, if the installer first inserts an end of a lamp into the spring-loaded socket which is electrically live, he may be tempted to place his thumb on the other end of the lamp to urge the lamp outwardly against the bias of the spring-loaded socket, thereby subjecting himself to possible electrical shock.

Underwriters Laboratories publishes safety standards that are applicable to the light fixture industry. Underwriters Laboratories has evaluated light fixtures for double-ended lamps and has recently promulgated a revised standard which requires light fixtures for double-ended lamps to include features that would diminish the risk of shock which could occur during the installation of double-ended lamps into lamp fixtures; e.g., UL 1571 Section 57A.3.

It is an object of the present invention to provide a light fixture for a double-ended lamp which meets standard 1571 Section 57A.3 promulgated by Underwriters Laboratories.

It is an additional object of the invention to provide a light fixture for a double-ended lamp which diminishes the risk of electrical shock to one who installs a lamp while the fixture is electrically energized.

It is a further object of the invention to provide a light fixture for a double-ended lamp which prevents one who is installing the lamp from touching one end of the lamp while another end is in contact with an electrical circuit.

SUMMARY OF THE INVENTION

The present invention comprises a light fixture with two insulators on opposite sides of the fixture. A first insulator contains a socket connected to an electrical circuit and a well in communication with the first socket. The well has a greater depth than the first socket. A second insulator on another side of the fixture has a second socket connected to the electrical circuit and a slot in communication with the socket. The second insulator is biased by a spring into a first position and can be retracted when pushed against the bias of the spring into a second position. While the second insulator is in the first position, the two sockets are disposed within the fixture at a distance from each other which is shorter than the length of the lamp.

To install the lamp, a first end of the lamp is placed into the well in the first insulator which is insulated from the electrical circuit. The second end of the lamp is then slid through the slot in the second insulator into contact with the second socket. At this point the walls around the well prevent the first end of the lamp from exiting the well and from being touched by an installer. The second insulator is then retracted against the bias of the spring to a second position which is a greater distance away from the first socket, thereby providing sufficient distance between the first and second sockets to allow the first end of the lamp to slide from the well into the first socket. Once each end of the lamp is engaged with its respective socket, the second insulator is released to allow the bias of the spring to press upon the ends of the lamp to firmly secure each end into its respective socket.

BRIEF DESCRIPTION OF THE DRAWINGS

The present invention will be described in detail with reference to the following figures:

FIG. 1 is a perspective view of the light fixture of the present invention;

FIG. 2 is a fragmentary perspective view of a retractable insulator of the light fixture shown in FIG. 1;

FIG. 3 is a fragmentary perspective view of another insulator of the light fixture shown in FIG. 1;

FIG. 4 is a horizontal sectional view of the light fixture taken along line 4—4 of FIG. 1;

DETAILED DESCRIPTION OF THE INVENTION

Figure 5:
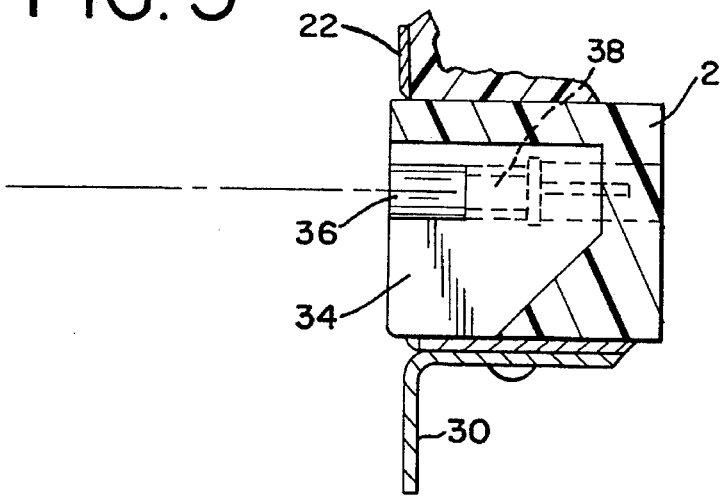
FIG. 5 is a fragmentary view of the horizontal sectional view shown in FIG. 4.

A fixture 10 of the present invention for accommodating a double-ended lamp 12 is shown in FIG. 1. The fixture 10 has an exterior housing 14 made of metal with an open face. The back of the housing 14 has a receptacle (not shown) for attaching the housing 14 to a support (not shown). The receptacle has an opening through which electrical wiring is routed. A rim 16 on the housing 14 surrounds the open face with two posts horizontally mounted on top of the rim 16 and two apertures provided on the rim 16 below the face.

The fixture 10 is closed off with a glass panel 18 circumferenced by a metal frame 20. The metal frame 20 has two horizontal bores for receiving the horizontal posts on the housing 14 and two apertures which line up with the apertures on the rim 16 of the housing 14. The bores on the rim 16 mate with the posts on the frame 20 so the glass panel 18 can hinge open and shut about the top of the rim 16 on the housing 14. When the glass panel 18 is shut, the apertures on the rim 16 line up with the apertures on the frame 20 of the panel 18 to allow securement with any conventional means such as screws. Removal of the securement means allows one to easily hinge open the glass panel 18 and obtain access to the lamp 12 inside the housing 14. The lamp is conventional and is in the form of a tube having a cylindrical terminal at each end thereof.

Figure 6:
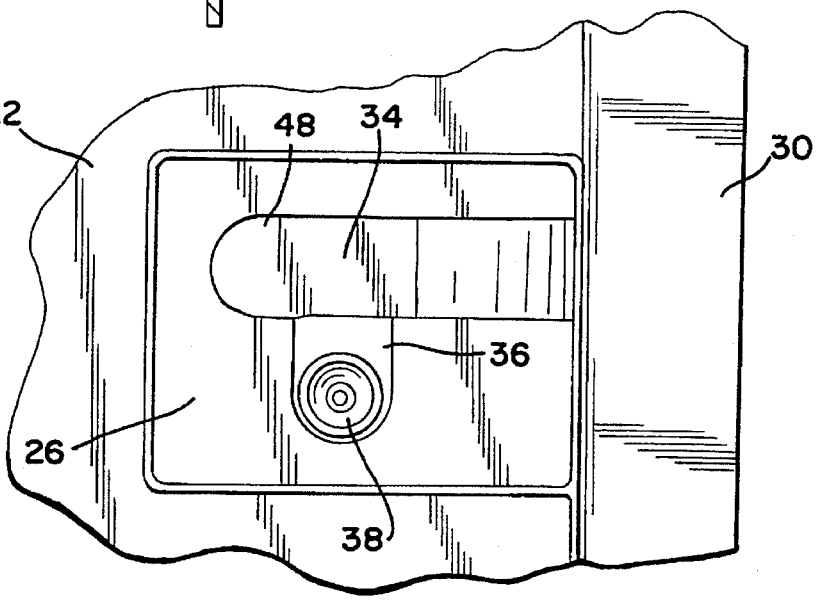
FIG. 6 is a fragmentary elevational view of the insulator shown in FIG. 3.
Figure 7:
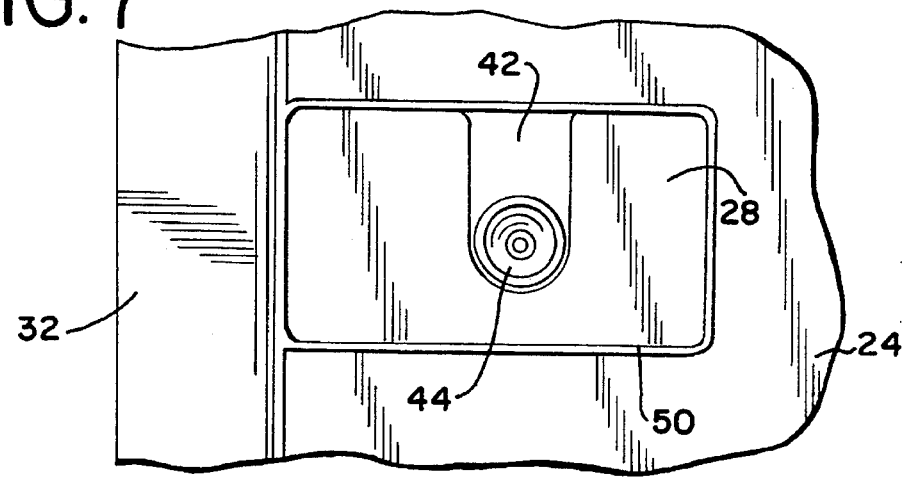
FIG. 7 is a fragmentary elevational view of the insulator shown in FIG. 2.

The fixture 10 has an interior with a parabolic back flanked by two sides covered with a reflective material. A first side supports a first inset side 22, and a second side supports a second inset side 24. A first insulator block 26 is disposed in the first inset side 22, as shown in FIGS. 3, 5 and 6. A second insulator block 28 is disposed in inset side 24, as best shown in FIGS. 2 and 7.

A first L-shaped bracket 30 is fastened between the first side and the first inset side 22, and a second L-shaped bracket 32 is fastened between the second side and the second inset side 24. The first insulator 26 defines a well 34 and a first slot 36 in communication with the well 34. The slot 36 cuts into the well 34 and into the insulator 26. The well 34 has a back wall at a depth that is greater than a depth of a back wall of the slot 36 in the insulator 26. A first socket 38 is defined in the back wall of the slot 36. The socket 38 comprises a cylindrical blind bore with a terminal at the end of the bore in contact with an electrical circuit (not shown). The width of the slot 36 is just in excess of the diameter of the cylindrical terminals on the lamp. The end of the bore is at a depth in the insulator 26 which is greater than the depth of the back wall of the slot 36 but less than the depth of the well 34. The bore of the socket 38 has a diameter just large enough to receive a first end 40 of the double-ended lamp 12. The diameter of the socket 38 is substantially the same, but in excess of, the diameter of the cylindrical terminals on the lamp. The well 34 is insulated from the electrical circuit, so that when said first end 40 of the double-ended lamp 12 is inserted into the well 34, no electrical current flows through the end 40 into the lamp 12. Moreover, once the first end 40 is disposed in the well 34, a person cannot place his finger in contact with an electrically conductive portion of the first end 40.

The second insulator 28 defines a second slot 42 which cuts into two sides of the insulator 28. A second socket 44 is disposed in a back wall of the slot 42 and has the same construction as the socket 38, with a cylindrical blind bore and an electrical terminal therein in contact with the electrical circuit. The bore of the socket 44 has a diameter just wide enough to receive a second end 46 of the double-ended lamp 12. The diameter of the bore 44 is substantially the same, but in excess of, the diameter of the cylindrical terminals on the lamp. The width of the slot 42 is just in excess of the diameter of the cylindrical terminals on the lamp.

The insulator 28 is disposed in a channel 50 in the second inset side 24. A spring 52 biases insulator 28 inwardly toward the center of the fixture 10 into a first position as shown in FIG. 1. The insulator 28 is retractable against the bias of the spring 52 from the first position to a second position as shown in FIG. 2.

The distance between the first socket 38 and the second socket 44 while insulator 28 is in the first position is shorter than the length of the double-ended lamp 12. Consequently, while the insulator 28 is in the first position, the lamp 12 can only fit between the well 34 and the second socket 44. Additionally, after the first end 40 of the double-ended lamp 12 is inserted into the well 34 and the second end 46 of the double-ended lamp 12 is inserted into the second socket 44 of the insulator 28 which is in the first position, the first end 40 of the double-ended lamp 12 cannot move from the well 34 through the first slot 36 into the first socket 38. Furthermore, while the second end 46 is engaged with the second socket 44, the side walls 48 comprising the well 34 cooperate with the first L-shaped bracket 30 to restrain the first end 40 of the double-ended lamp 12 from exiting the well 34.

The first slot 36 and the second slot 42 are sufficiently narrow and the first socket 38 and the second socket 44 are sufficiently deep to prevent the first end 40 and the second end 46 of the lamp 12 from entering the first socket 38 and the second socket 44, respectively, from a substantial angle with respect to an imaginary horizontal line 54 connecting the first socket 38 and the second socket 44 as indicated in phantom in FIG. 4. The distance between the first insulator 26 and the second insulator 28 is sufficiently small to cooperate with the width of the upwardly extended portions of the first L-shaped bracket 30 and the second L-shaped bracket 32 to prevent either first end 40 or second end 46 from entering into the respective first socket 38 or second socket 44 along the imaginary horizontal line 54 as also indicated in phantom in FIG. 4. Thus, each bracket acts as an obstruction to prevent the lamp from being installed in an improper manner. Consequently, for the second end 46 to enter the second socket 44 as required along the imaginary horizontal line 54, the first end 40 must be first inserted into the well 34. Moreover, for the first end 40 to enter into the first socket 38 as required along the imaginary horizontal line 54, the second end 46 must be inserted first into the second socket 44.

To install the double-ended lamp 12 into the light fixture 10 of the present invention, the following procedure is required. Preliminarily, the power to the fixture is shut off, the securement means securing the glass panel 18 to the housing 14 is removed, and the glass panel 18 is hinged open to provide access to the interior of the housing 14. To install the lamp, first, the first end 40 of the double-ended lamp 12 is inserted into the well 34, as shown in FIGS. 1 and 4. While the first end 40 is disposed in the well 34, contact with the second end 46 of the double-ended lamp 12 will not precipitate electrical discharge because the well 34 is insulated from the electrical circuit connected to the first socket 38. Second, the second end 46 of the double-ended lamp 12 is then slid through second slot 42 into the second socket 44 and into contact with the electrical circuit as shown in FIG. 1. Third, the second insulator 28 is depressed against the bias of the spring 52 into the second position, as shown in FIG.

2, to increase the distance between the first socket 38 and the second socket 44. Fourth, while the second insulator 28 is depressed into the second position, the first end 40 of the double-ended lamp 12 is slid from the well 34 through the first slot 36 and into the opening of the first socket 38, as shown in FIG. 3, and the depression of insulator 28 is released to allow the spring 52 to bear on the second insulator 28 and urge the first end 40 of the double-ended lamp 12 to enter into the first socket 38 and engage the electrical contact therein. Consequently, firm engagement between the first socket 38 and the first end 40, and the second socket 44 and the second end 46, respectively, is secured.

Once the lamp 12 is installed and securely engaged to the first socket 38 and the second socket 44, the electrical circuit can be connected to the power supply to allow current to flow through lamp 12 and illuminate the light fixture 10.

The double-ended lamp 12 may be removed by easily performing the reverse procedure. Again preliminarily, the power is shut off, the securement means in the glass panel 18 is removed and the panel 18 pivoted is upward to provide access to the interior. To remove the lamp 12, first, the second insulator 28 is depressed from the first position to the second position to provide greater distance between the first socket 38 and the second socket 44. Second, the first end 40 of the double-ended lamp 12 is removed from the first socket 38 and moved through the first slot 36 into the well 34. Third, the depression of the second insulator 28 is released to allow the spring 52 to bias the second insulator 28 into the first position. Fourth, the second end 46 of the lamp 12 is removed from the second socket 44 and out of the second slot 42. Fifth, the first end 40 of the lamp 12 is removed from the well 34 and the lamp 12 retrieved from the housing 14.

As can be seen, the fixture 10 of the present invention is designed to prevent an installer from experiencing shock even if he leaves the power on during installation or removal. Neither of the first end 40 or the second end 46 can be inserted into engagement with the first socket 38 or the second socket 44 unless the opposite end, the second end 46 or the first end 40, respectively, is shielded from contact with the installer. This simple and quick procedure will mitigate the risks inherent with installing a double-ended lamp 12 into a light fixture 10.

While a preferred embodiment of the present invention has been shown and described, it should be understood that the invention is not limited thereto, since many modifications may be made. The invention is therefore contemplated to cover by the present application any and all such modifications which fall within the true spirit and scope of the basic underlying principles disclosed and claimed herein.

What is claimed is:

1. A fixture for receiving an elongated lamp having a terminal at each end thereof, said fixture comprising:

a housing mounting oppositely disposed first and second insulator blocks, said first insulator block being fixedly mounted and said second insulator block being supported for movement back and forth between a first position toward said first insulator block and a second position away from said first insulator block, said first insulator block having a first socket with a terminal therein for receiving one end of the lamp and a well communicating with said first socket, the well having a depth greater than the depth of the first socket, said second insulator block having a second socket with a terminal therein for receiving the other end of the lamp, the distance between said first and second sockets being less than the length of said lamp when said second insulator block is in said first position, obstruction means on said housing for preventing the lamp from being oriented such that one end of the lamp can be engaged with the terminal in said second socket when the other end of the lamp is disposed exteriorly of the well in said first insulator block, whereby said lamp may be mounted in place only by first inserting one end of the lamp in said well followed by insertion of the other end of the lamp in said second socket for engaging the terminal therein after movement of the second socket to its second position, whereupon said one end of the lamp may then be moved from said well to said first socket for engagement with the terminal therein.

2. A fixture as recited in claim 1, wherein said well is electrically insulated from said first socket.

3. A fixture as recited in claim 1, wherein said well includes surrounding walls which restrict removal of said one end of said lamp from said well when said other end of said lamp is in engagement with said second socket in said first position.

4. A fixture as recited in claim 1, wherein said first insulator block defines a first slot which interconnects said well and said first socket for facilitating movement of said first end from said well into said one socket.

5. A fixture as recited in claim 4, wherein said slot has a predetermined depth which is less than said depth of said well.

6. A fixture as recited in claim 5, wherein said predetermined depth of said first socket is greater than said predetermined depth of said slot.

7. A fixture as recited in claim 1, wherein said second insulator defines a second slot in communication with said other socket to facilitate engagement of said second end of said lamp with said second socket.

8. A fixture as recited in claim 1, wherein said first socket is sufficiently narrow to prevent reception of said one end of said lamp unless said one end is directed into said first socket substantially along an imaginary horizontal line which extends between said first socket and said second socket.

9. A fixture as recited in claim 8, wherein said distance between said first socket and said second socket is insufficient for said one end of said lamp to enter said first socket without said second end being engaged with said other socket.

10. A fixture as recited in claim 8, wherein an upwardly extended portion of an L-shaped bracket disposed above said second socket blocks said first end of said lamp from being inserted into said first socket substantially along said imaginary horizontal line without said second end being engaged with said second socket.

11. A fixture as recited in claim 1, wherein said second socket is sufficiently narrow to prevent reception of said other end of said lamp unless said other end is directed into said second socket substantially along an imaginary horizontal line which extends between said first socket and said second socket.

12. A fixture as recited in claim 11, wherein said distance between said first socket and said second socket is insufficiently small for said other end of said lamp to enter said second socket without said one end being disposed within said well.

13. A fixture as recited in claim 12, wherein an upwardly extended portion of an L-shaped bracket disposed above said first socket blocks said lamp from approaching said second socket substantially along said imaginary horizontal line without said one end being disposed within said well.

14. The fixture according to claim 1 further defined by:

said lamp being in the form of a tube having cylindrical terminals at each end thereof, said first socket being in the form of a blind bore having a diameter substantially the same, but in excess of, the diameter of the cylindrical terminal on the lamp, said second socket having a width substantially the same as, but in excess of, the diameter of the cylindrical terminal of the lamp.

15. The fixture according to claim 14 further defined by:

said first insulator block including a slot communicating said well with said first socket, the depth of said slot being less than the depth of said first socket.

16. A fixture for receiving a lamp, said fixture comprising: a first insulator defining a first socket for receiving a first end of said lamp, said first insulator defining a well in communication with said first socket; a second insulator defining a second socket for receiving a second end of said lamp, said second insulator being retractable between a first position and a second position; said second socket having a first predetermined depth while said second insulator is in said first position which cooperates with a predetermined depth of said well to accommodate a lamp between said well and said second socket; said second socket having a second predetermined depth while said second insulator is in said second position which cooperates with a predetermined depth of said first socket to accommodate said lamp between said first socket and said second socket, said first socket being sufficiently narrow to prevent reception of said first end of said lamp unless said first end is directed into said first socket substantially along an imaginary horizontal line which extends between said first socket and said second socket, a bracket disposed above said second socket for blocking said first end of said lamp from being inserted into said first socket substantially along said imaginary horizontal line without said second end being engaged with said second socket.

17. A fixture for receiving a lamp, said fixture comprising: a first insulator defining a first socket for receiving a first end of said lamp, said first insulator defining a well in communication with said first socket; a second insulator defining a second socket for receiving a second end of said lamp, said second insulator being retractable between a first position and a second position; said second socket having a first predetermined depth while said second insulator is in said first position which cooperates with a predetermined depth of said well to accommodate a lamp between said well and said second socket; said second socket having a second predetermined depth while said second insulator is in said second position which cooperates with a predetermined depth of said first socket to accommodate said lamp between said first socket and said second socket, said second socket being sufficiently narrow to prevent reception of said second end of said lamp unless said second end is directed into said second socket substantially along an imaginary horizontal line which extends between said first socket and said second socket, the distance between said first socket and said second socket being insufficient for said second end of said lamp to enter said second socket without said first end being disposed within said well, and a bracket disposed above said first socket for blocking said lamp from approaching said second socket substantially along said imaginary horizontal line without said first end being disposed within said well.

* * * * *